US008092164B2

(12) United States Patent
Moon et al.

(10) Patent No.: US 8,092,164 B2
(45) Date of Patent: Jan. 10, 2012

(54) OVERLAP INTERFACE FOR A GAS TURBINE ENGINE COMPOSITE ENGINE CASE

(75) Inventors: Francis R. Moon, Granby, CT (US); Lars H. Vestergaard, Glastonbury, CT (US); Richard W. Monahan, Farmington, CT (US)

(73) Assignee: United Technologies Corporation, Hartford, CT (US)

( * ) Notice: Subject to any disclaimer, the term of this patent is extended or adjusted under 35 U.S.C. 154(b) by 1163 days.

(21) Appl. No.: 11/847,432

(22) Filed: Aug. 30, 2007

(65) Prior Publication Data

US 2009/0060733 A1 Mar. 5, 2009

(51) Int. Cl.
*F01D 25/24* (2006.01)

(52) U.S. Cl. ..... 415/200

(58) Field of Classification Search ..... 415/144, 415/213.1, 214.1, 215.1, 200, 220
See application file for complete search history.

(56) References Cited

U.S. PATENT DOCUMENTS 4,248,649 A * 2/1981 Harrison et al. ..... 156/174
4,428,189 A 1/1984 Greenberg et al.
4,658,579 A 4/1987 Bower et al.
5,041,318 A * 8/1991 Hulls ..... 428/57
5,118,253 A 6/1992 Balkeum, III
5,127,797 A 7/1992 Carman
5,160,248 A 11/1992 Clarke
5,180,281 A 1/1993 Burge et al.
5,354,174 A 10/1994 Balkeum et al.
6,123,170 A * 9/2000 Porte et al. ..... 181/214
6,227,794 B1 5/2001 Wojtyczka et al.
6,364,606 B1 4/2002 Rice et al.
6,375,121 B1 * 4/2002 Porte et al. ..... 244/129.4
6,637,186 B1 10/2003 Van Duyn
6,652,222 B1 11/2003 Wojtyczka et al.
6,681,577 B2 1/2004 Bolender et al.
6,821,087 B2 * 11/2004 Matsumoto et al. ..... 415/191
6,881,032 B2 4/2005 Malmborg
6,895,756 B2 * 5/2005 Schmotolocha et al. ..... 60/761
6,944,580 B1 9/2005 Blume et al.
6,962,482 B2 11/2005 Tanaka
7,010,906 B2 3/2006 Cazenave et al.
7,100,358 B2 9/2006 Gekht et al.
2004/0045765 A1 * 3/2004 Porte ..... 181/210
2006/0201135 A1 * 9/2006 Xie et al. ..... 60/226.1

* cited by examiner

*Primary Examiner* — Edward Look
*Assistant Examiner* — Jesse Prager
(74) *Attorney, Agent, or Firm* — Carlson Gaskey & Olds, P.C.

(57) ABSTRACT

A composite engine case with an axial interface. One configuration includes an alternating mix of full length and partial plies, in order to provide the total thickness needed for the axial overlap. Another configuration provides only full-length structural plies with a flyaway insert adjacent the axial interface.

11 Claims, 6 Drawing Sheets

Schematic of Circular ID Overlap

OVERLAP INTERFACE FOR A GAS TURBINE ENGINE COMPOSITE ENGINE CASE

This invention was made with government support under Contract No.: N00019-02-C-3003. The government therefore has certain rights in this invention.

BACKGROUND OF THE INVENTION

The present invention relates to an engine case for a gas turbine engine.

A gas turbine engine, such as a turbofan engine for an aircraft, includes a fan section, a compression section, a combustion section, and a turbine section. An axis of the engine is centrally disposed within the engine, and extends longitudinally through these sections. A primary flow path for working medium gases extends axially through the engine. A secondary flow path for working medium gases extends radially outward of the primary flow path.

The secondary flow path is typically defined by a bypass duct formed from a multiple of portions which are fitted together along a flange arrangement. Although effective for metallic duct structures, composite bypass ducts for military engines require other interface arrangements. The viability of turned-up axial flanges on composite components may be relatively low due to a lack of duct circumferential stiffness at mid-span. Additional difficulties may arise in mitered turned-up axial and circumferential flanges.

SUMMARY OF THE INVENTION

The composite engine case according to the present invention provides an axial interface for single-walled composite pressure vessels utilized in gas turbine engines. One configuration includes an alternating mix of full length and partial plies to provide the total thickness required at the axial interface. This configuration provides for strength through the thickness at the axial interface. Another configuration provides only full-length structural plies at the axial interface. Flyaway inserts co-cured into the lay-up along the inner mold line (IML) side provide the required thickness.

The composite engine case without the complications of a 3D or corner turned-up flange provides a less labor-intensive lay-up process; a simpler mold; less likelihood for voids due to tight/sudden bends; and more efficient use of ply orientation at the axial interface.

The present invention therefore provides an effective axial interface for multi-section composite engine cases with substantial circumferential stiffness at mid-span.

BRIEF DESCRIPTION OF THE DRAWINGS

The various features and advantages of this invention will become apparent to those skilled in the art from the following detailed description of the currently disclosed embodiment. The drawings that accompany the detailed description can be briefly described as follows.

DETAILED DESCRIPTION OF THE DISCLOSED EMBODIMENT

Figure 1:
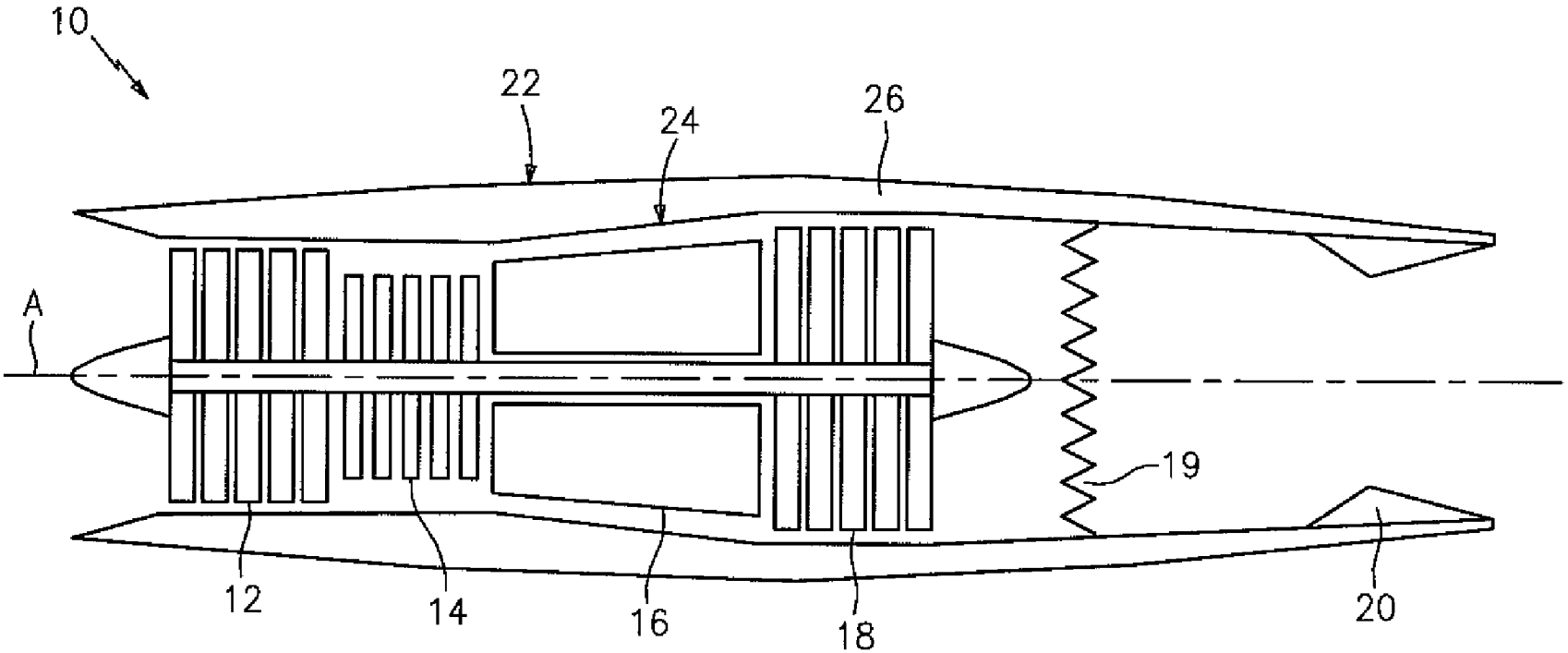
FIG. 1 is a general perspective view an exemplary gas turbine engine embodiment for use with the present invention.

FIG. 1 schematically illustrates a gas turbine engine 10 which generally includes a fan section 12, a compressor section 14, a combustor section 16, a turbine section 18, an augmentor section 19, and a nozzle section 20. The compressor section 14, combustor section 16, and turbine section 18 are generally referred to as the core engine. An axis of the engine A is centrally disposed and extends longitudinally through these sections. Within and aft of the combustor 16, engine components are typically cooled due to intense temperatures of the combustion core gases.

An outer engine duct structure 22 and an inner cooling liner structure 24 define an annular secondary fan bypass flow path 26 around a primary exhaust flow (illustrated schematically by arrow E). It should be understood that various structure within the engine may be defined as the outer engine case 22 and the inner cooling liner structure 24 to define various cooling airflow paths such as the disclosed fan bypass flow path 26. The fan bypass flow path 26 guides a secondary flow or cooling airflow (illustrated schematically by arrows C, FIG. 2) between the outer engine case 22 and the inner cooling liner structure 24. Cooling airflow C and/or other secondary airflow that is different from the primary exhaust gas flow E is typically sourced from the fan section 12 and/or compressor section 14. The cooling airflow C is utilized for a multiple of purposes including, for example, pressurization and partial shielding of the nozzle section 20 from the intense heat of the exhaust gas flow F during particular operational profiles.

Figure 2:
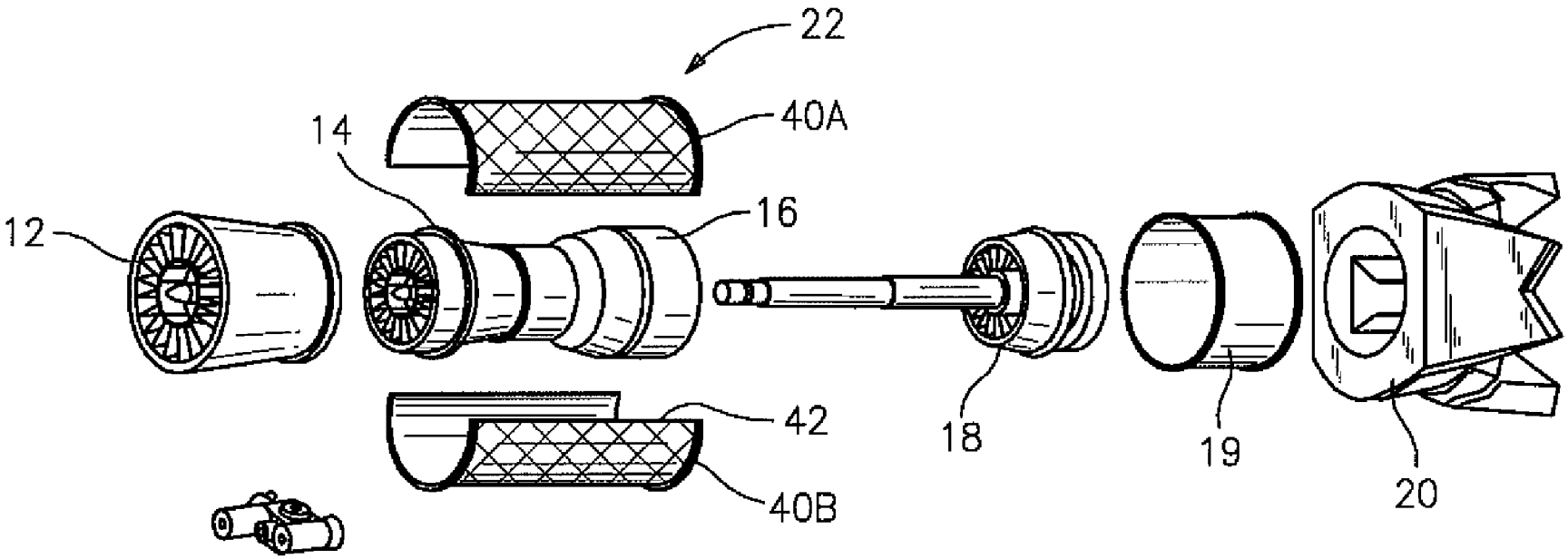
FIG. 2 is a perspective exploded view of the gas turbine engine illustrating the composite engine case.

The fan bypass flow path 26 is generally defined by the outer engine case 22 having a first section 40A which may be an upper half and a second section 40B which may be a lower half (FIG. 2). The first section 40A engages the second section 40B along an axial interface 42 (illustrated as a lateral section in FIG. 3). It should be understood that although the first section 40A and the second section 40B are disclosed as a particular module of the engine and that other engine sections and pressure vessels may alternatively or additionally benefit from the axial interface 42.

Figure 3:
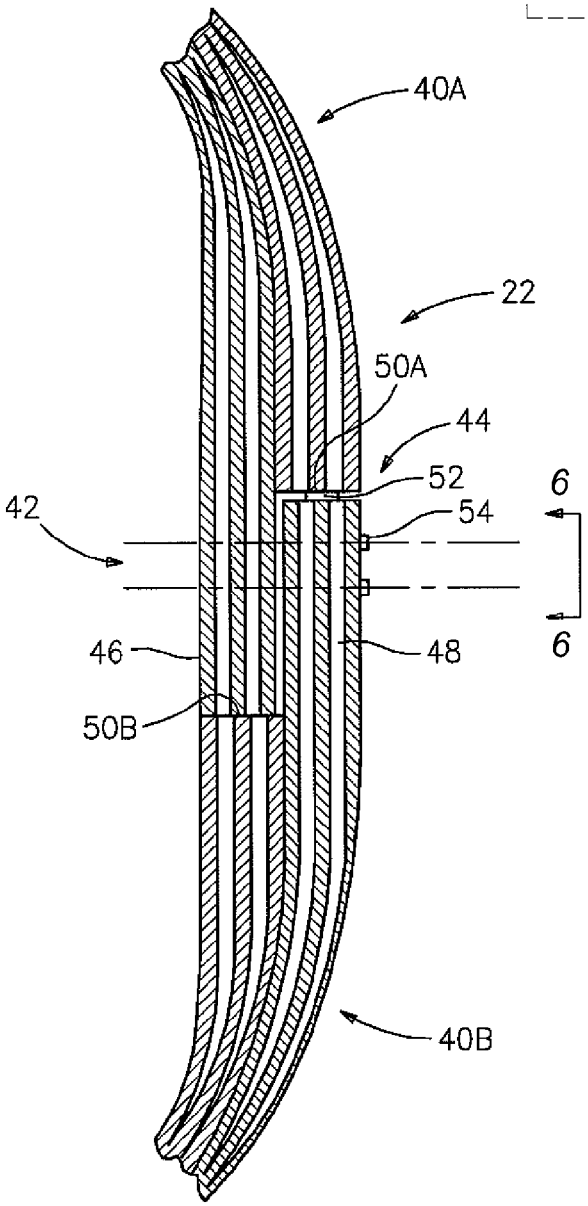
FIG. 3 is a sectional view of the composite engine case through one axial interface therefor.
Figure 4:
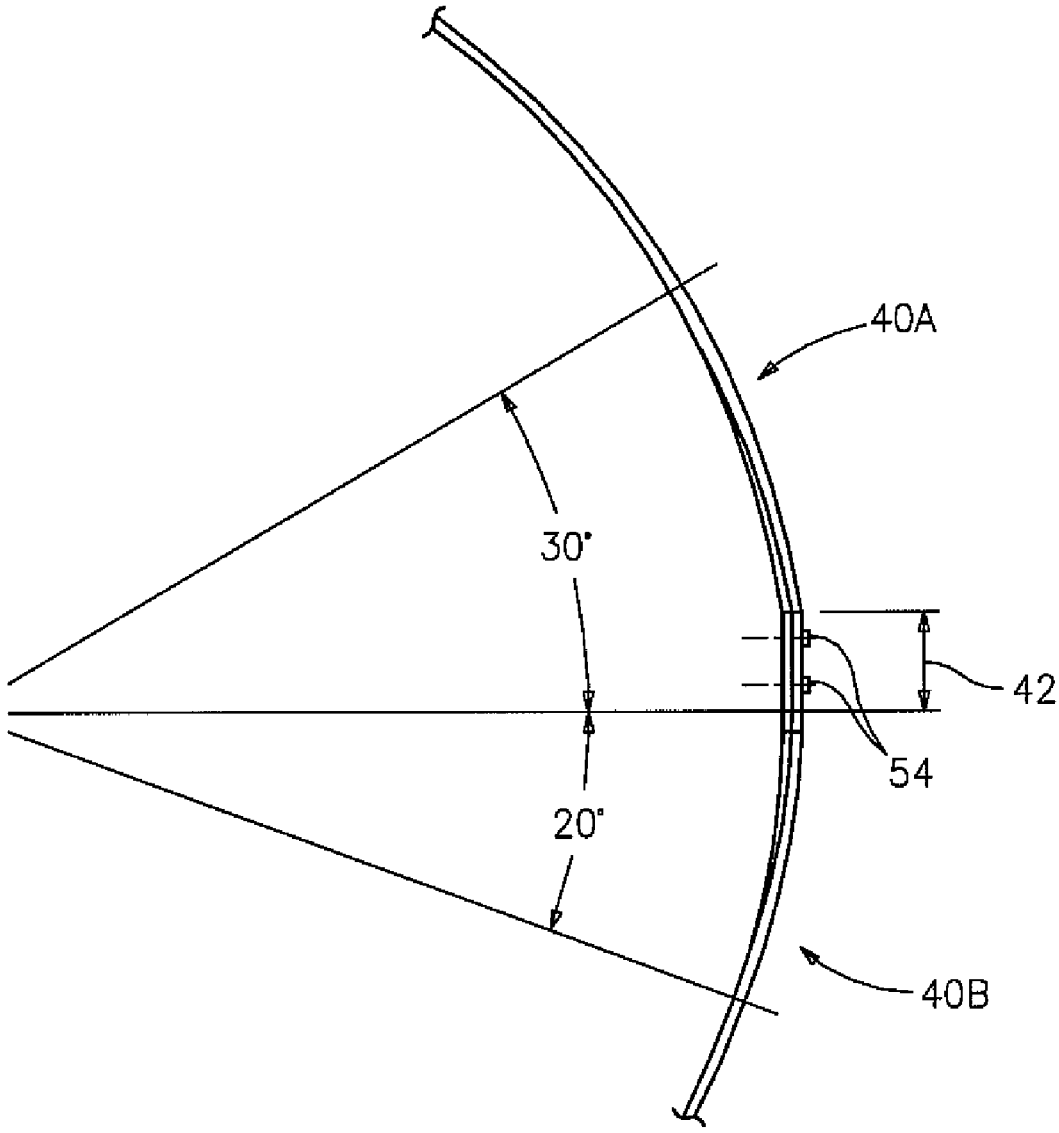
FIG. 4 is an larger sectional view of the composite engine case illustrating thickness areas.
Figure 5:
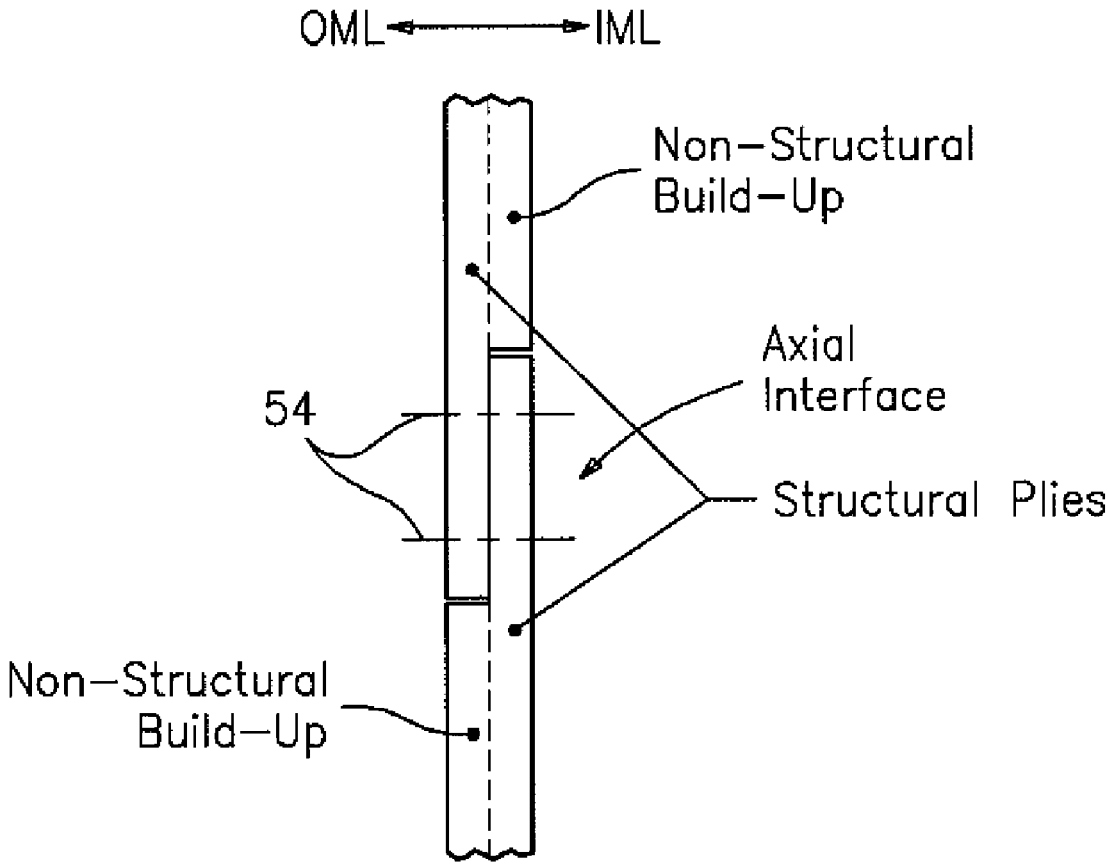
FIG. 5 is a simplified sectional view of the composite engine case axial interface.

Referring to FIG. 3, the axial interface 42 includes an alternating mix of full-length and partial-length plies to provide a desired total thickness required for strength at the axial interface 42. This configuration provides for strength through the thickness of the integration of partial-length plies at the axial interface 42. That is, the outer engine case 22 is thicker adjacent the axial interface 42 than at the remainder of the first section 40A and the second section 40B. The thickness may begin to increase in the respective first section 40A and second section 40B at approximately 30 degrees and 20 degree circumferential position defined on each side of the axial interface 42 (FIG. 4). Generally, the increased thickness at the axial interface is provided by non-structural build-up plies integrated or added to the structural plies (FIG. 5). Alternatively, the non-structural build-up plies may be eliminated such that only the lap-joint of structural plies remain.

The axial interface 42 defines a stepped interface 44 in lateral cross-section. The stepped interface 44 is defined by an extended portion 46 of the first section 40A which overlaps an extended portion 48 of the second section 40B. The full length continuous plies are located along ether side of the extended portions 46, 48 to provide an overlap which minimizes delamination and crack propagation at the axial interface 42.

The first section 40A of the stepped interface 44 defines first ledge 50A and the second section 40B defines a second ledge 50B. The extended portion 46 of the first section 40A rests upon the second ledge 50B of the second section 40B while the extended portion 48 of the second section 40B rests upon the first ledge 50A of the first section 40A.

A seal 52 may be located along the first ledge 50A to seal the first section 40A and the second section 40B about an outer perimeter thereof. Alternatively, a portion of the first section 40A above the extended portion 48 of the second section 40B may be removed along with the axial seal 52.

Figure 6:
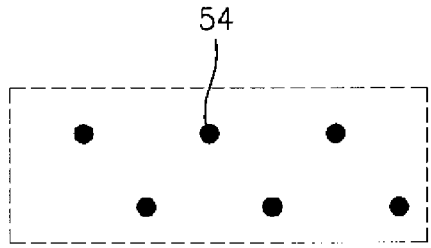
FIG. 6 is a plan view of a fastener pattern in a lap joint.

The extended portion 46 of the first section 40A overlaps the extended portion 48 of the second section 40B to define a lap joint which receives a multiple of fasteners 54. The multiple of fasteners 54 may be arranged in a stagger pattern (FIG. 6) which minimizes the number of fasteners required by providing additional outer engine case 22 material therebetween.

Figure 7:
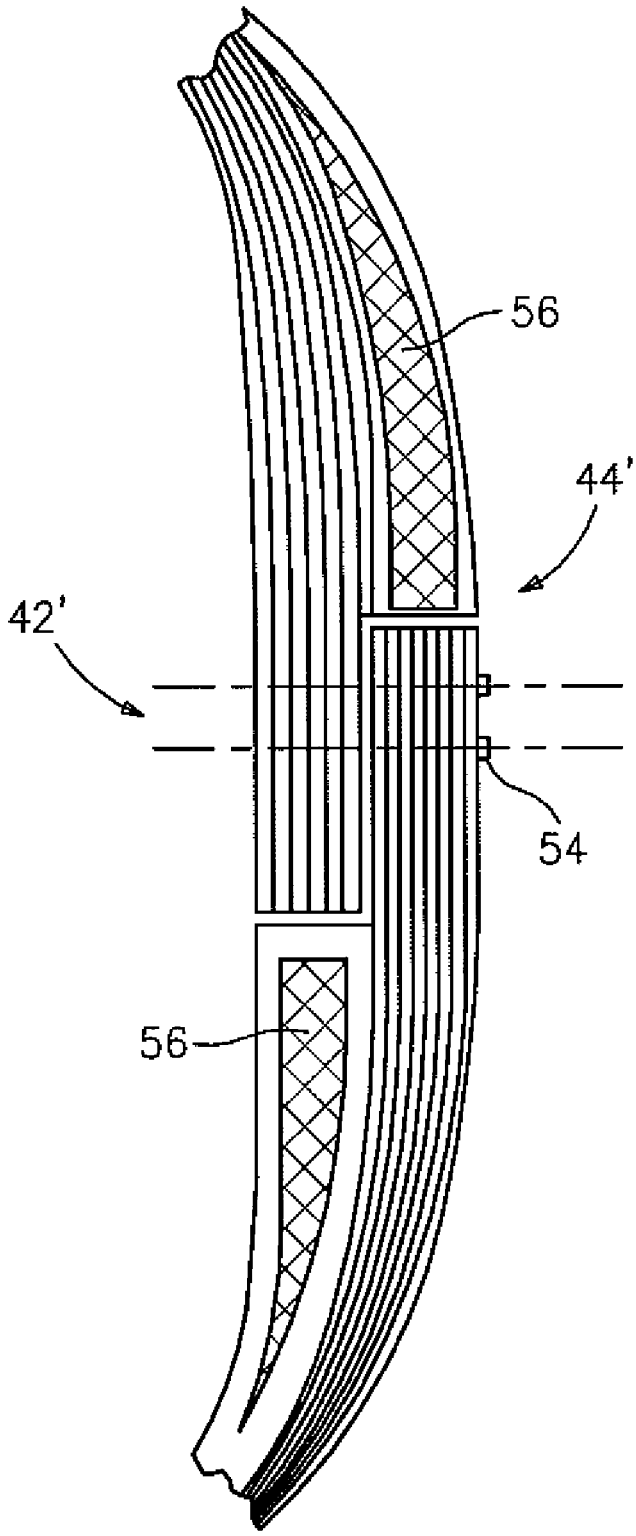
FIG. 7 is a sectional view of the composite engine case through another axial interface therefor.

Referring to FIG. 7, another axial interface 42' includes only full-length structural plies to define a portion of the stepped interface 44' as described above. The axial interface 42' includes flyaway inserts 56 co-cured into the lay-up along the inner mold line (IML) side to provide the required thickness. It should be understood that other lightweight inserts which provide the desired thickness may alternatively or additionally be provided.

It should be understood that relative positional terms such as "forward," "aft," "upper," "lower," "above," "below," and the like are with reference to the normal operational attitude of the vehicle and should not be considered otherwise limiting.

It should be understood that although a particular component arrangement is disclosed in the illustrated embodiment, other arrangements will benefit from the instant invention.

Although particular step sequences are shown, described, and claimed, it should be understood that steps may be performed in any order, separated or combined unless otherwise indicated and will still benefit from the present invention.

The foregoing description is exemplary rather than defined by the limitations within. Many modifications and variations of the present invention are possible in light of the above teachings. The disclosed embodiments of this invention have been disclosed, however, one of ordinary skill in the art would recognize that certain modifications would come within the scope of this invention. It is, therefore, to be understood that within the scope of the appended claims, the invention may be practiced otherwise than as specifically described. For that reason the following claims should be studied to determine the true scope and content of this invention.

What is claimed is:

1. A composite engine case for a gas turbine engine comprising:

a first composite duct section defined along a longitudinal axis;

a second composite duct section defined along said longitudinal axis, said second composite duct section mateable with said first composite duct section along an axial interface with a first extended portion of said first composite duct section which overlaps a second extended portion of said second composite duct section, said axial interface defined by a first increased thickness area of said first composite duct section and a second increased thickness area of said second composite duct section; and a fly-away insert within said first composite duct section and said second composite duct section adjacent to said axial interface, said first extended portion of said first composite duct section and said second extended portion of said second composite duct section adjacent to said fly-away insert.

2. The composite engine case as recited in claim 1, wherein said axial interface defines a step in lateral cross-section formed by said first extended portion of said first composite duct section which overlaps said second extended portion of said second composite duct section.

3. The composite engine case as recited in claim 1, wherein said first increased thickness area and said second increased thickness area are defined within a 30 degree arc on each side of said axial interface.

4. The composite engine case as recited in claim 1, further comprising a lap joint formed by said first extended portion of said first composite duct section which overlaps said second extended portion of said second composite duct section.

5. The composite engine case as recited in claim 1, wherein said axial interface defines a step in lateral cross-section.

6. The composite engine case as recited in claim 1, further comprising a full-length structural ply within said first extended portion of said first composite duct section and a full-length structural ply within said second extended portion of said second composite duct section.

7. A composite engine case for a gas turbine engine comprising:

a first composite duct section defined along a longitudinal axis; and a second composite duct section defined along said longitudinal axis, said second composite duct section mateable with said first composite duct section along an axial interface with a first extended portion of said first composite duct section which overlaps a second extended portion of said second composite duct section, said axial interface defined by a first increased thickness area of said first composite duct section and a second increased thickness area of said second composite duct section, said axial interface defines an overlap having an alternating mix of full length and partial plies to form said first extended portion of said first composite duct section and said second extended portion of said second composite duct section formed from at least one continuous ply.

8. The composite engine case as recited in claim 1, further comprising full-length structural plies which extend about a perimeter of said first composite duct section and said second composite duct section said full-length structural plies extend into said first extended portion of said first composite duct section and extend into said second extended portion of said second composite duct.

9. A composite engine case for a gas turbine engine comprising:

a first composite duct section defined along a longitudinal axis; and a second composite duct section defined along said longitudinal axis, said second composite duct section mateable with said first composite duct section along an axial interface with a first extended portion of said first composite duct section which overlaps a second extended portion of said second composite duct section, said axial interface defined by a first increased thickness area of said first composite duct section and a second increased thickness area of said second composite duct section; and a fly-away insert within said first composite duct section and said second composite duct section along said axial interface, said fly-away insert external to said first extended portion of said first composite duct section and said second extended portion of said second composite duct section.

10. The composite engine case as recited in claim 1, wherein said first extended portion of said first composite duct section and said second extended portion of said second composite duct section are structural build-ups.

11. The composite engine case as recited in claim 10, wherein a first remainder of said first increased thickness area of said first composite duct section and a second remainder of said second increased thickness area of said second composite duct section within said axial interface are non-structural build-ups.

* * * * *